US007034756B2

(12) United States Patent
Fujii et al.

(10) Patent No.: US 7,034,756 B2
(45) Date of Patent: Apr. 25, 2006

(54) ANTENNA COIL DEVICE

(75) Inventors: Hiroyuki Fujii, Matsuzaka (JP); Masaki Saito, Tokyo (JP); Tomoko Mito, Tokyo (JP)

(73) Assignees: Central Glass Co., Ltd., Yamaguchi (JP); Sumida Corporation, Tokyo (JP)

( * ) Notice: Subject to any disclaimer, the term of this patent is extended or adjusted under 35 U.S.C. 154(b) by 0 days.

(21) Appl. No.: 10/934,424

(22) Filed: Sep. 7, 2004

(65) Prior Publication Data

US 2005/0052337 A1 Mar. 10, 2005

(30) Foreign Application Priority Data

Sep. 8, 2003 (JP) ..... 2003-315173

(51) Int. Cl.
*H01Q 1/32* (2006.01)

(52) U.S. Cl. ..... 343/713; 343/788

(58) Field of Classification Search ..... 343/713, 343/787, 788, 711

See application file for complete search history.

(56) References Cited

U.S. PATENT DOCUMENTS

| | | | | |
|---|---|---|---|---|
| 4,752,680 | A | 6/1988 | Larsson | 235/492 |
| 5,334,988 | A * | 8/1994 | Murakami et al. | 343/704 |

FOREIGN PATENT DOCUMENTS

| | | |
|---|---|---|
| JP | 8-335820 | 12/1996 |
| JP | 9-213528 | 8/1997 |
| JP | 10-189350 | 7/1998 |

* cited by examiner

*Primary Examiner*—Hoang V. Nguyen
(74) *Attorney, Agent, or Firm*—Snider & Associates; Ronald R. Snider

(57) ABSTRACT

In an antenna coil device 11, a coil portion 12 having a lead wire 2 wound around a magnetic core 1 is mounted on a case 3 made of plastic resin, and on one side of the case 3, terminal boards 4 and 5 that electrically connect one end and the other end of the lead wire 2 of the coil portion 12 to an external device are placed in a protruding manner. A through hole 4D is provided in an inserting end portion 4C of the terminal board 4, a through hole 5H is provided in a central flat portion 5G of the terminal board 5, and the two through holes 4D and 5H are placed opposite each other. This reduces stray capacitance caused between the two terminal boards 4 and 5 connected to both ends of the coil portion 12, and allows a self resonance frequency band where an impedance is equal to or above a predetermined value to be shifted to a high frequency side.

4 Claims, 7 Drawing Sheets

ANTENNA COIL DEVICE

RELATED APPLICATIONS

This application claims the priority of Japanese Patent Application No. 2003-315173 filed on Sep. 8, 2003, which is incorporated herein by reference.

BACKGROUND OF THE INVENTION

1. Field of the Invention

The present invention relates to, for example, an antenna coil device, provided on a busbar of defogging heating elements of a rear window glass of a vehicle. More particularly, the present invention relates to, for example, an antenna coil device for preventing noise from being superimposed on radio broadcast signals received by an automobile glass antenna, or for improving receiving sensitivity.

2. Description of the Prior Art

An automobile glass antenna has been known that uses heating elements of a defogger provided in a rear window or antenna element provided around the heating elements as an antenna for radio broadcast or TV broadcast in order to receive radio broadcast or TV broadcast in a vehicle.

Radio wave signals of radio broadcast or TV broadcast received by such a glass antenna for a vehicle is affected by noise included in an output of a battery for supplying power to the heating elements of the defogger, or the received radio wave signals which leak through a feeder to a body or a DC power supply.

For this reason, a coil device is connected between defogging heating elements of a rear window glass of a vehicle and the body or the DC power supply to increase an impedance between a busbar and the body or the busbar and the DC power supply, thereby preventing current leaks. Further, in order to prevent the received radio wave signals from leaking from the feeder for the defogger to the body, a coil held by a resin member is connected and secured onto the busbar by soldering or the like.

Known conventional antenna coil devices for removing noise in radio wave signals of radio broadcast or TV broadcast received by an automobile glass antenna are described in, for example, Japanese Unexamined Patent Publication Nos. HEI 8-335820 and HEI 9-213528.

In the above described automobile glass antenna coil device, both ends of a lead wire of a wound coil body (hereinafter simply referred to as a coil) are each connected to corresponding terminal boards, and a DC current for a defogger input through the terminal boards passes through the coil. Generally, input/output positions of external signals to the two terminal boards are on the same side (referred to as a front side of the coil), and thus one terminal board, to which a back end of the coil is connected, axially extends from the front side to a back side of the coil, and is placed close to and opposite the other terminal board in a midway region.

The coil and the terminal boards are made of high conductive metal, and in order to prevent heating in the coil device, the cross-sectional area of the coil is designed to be large and the terminal boards are designed to be thick.

Such a coil device is mounted to an automobile, and strength at the time of mounting needs to be ensured to provide a vibration-resistant structure, and thus each terminal board is as wide as the coil and surrounded by a resin member to increase strength.

In the above described automobile glass antenna coil device, the two terminal boards are placed close to and opposite each other, thereby causing stray capacitance between the terminal boards.

However, as described above, each terminal board is as wide as the coil and has a large area in order to increase the strength, thus causing large stray capacitance proportional to an area of an opposite region between the terminal boards.

On the other hand, a self resonance frequency f is expressed by $1/(2\pi(LC)^{1/2})$ where C is a stray capacitance component and L is an inductance component of the coil (inductor), and the self resonance frequency f decreases as the stray capacitance component C increases.

Therefore, in the coil device, the terminal board is as wide as the coil and has the large area to reduce the self resonance frequency f, and reduce an impedance in, for example, a desired FM frequency band, especially in a high frequency band thereof, thereby causing difficulty in removing noise, and reducing sensitivity of an antenna.

For the device described in Japanese Unexamined Patent Publication No. HEI 8-335820, a stray capacitance component C increases as described above to require a reduction in a inductance component L, and to thus reduce an impedance, thereby causing difficulty in removing noise and improving sensitivity of an antenna.

For the device described in Japanese Unexamined Patent Publication No. HEI 9-213528, a dielectric is provided, and a resonance frequency is adjusted by changing the dielectric. However, a portion on which the dielectric is provided is extremely weakened, and providing a reinforcing member for reinforcing the portion increases costs resulting from an increase in the number of parts, and also causes a wide range of performance variations.

The invention is achieved in view of such circumstances, and has an object to provide an antenna coil device that has a simple structure, prevents an increase in stray capacitance caused between opposite terminal boards to prevent a reduction in a self resonance frequency, and improves sensitivity of an antenna while ensuring a noise removing function in a desired frequency band of a received signal, even if each terminal board of the coil device is wide and has a large area.

The above described problems are caused by an increase in a surface area of a conductor of opposite terminal boards of a coil device.

SUMMARY OF THE INVENTION

The present invention provides an antenna coil device that is connected to a busbar of defogging heating elements of a window glass of a mobile unit, and holds a coil by a holding member formed of an insulator and two terminal boards to which a winding of the coil is connected, wherein the two terminal boards to which the winding of the coil is connected are placed opposite each other, and at least one of the two terminal boards has a through hole in a region where the two terminal boards are opposite to each other.

A size of the through hole in the width direction of the terminal board on which the through hole is provided is preferably ¾ or less of a width of the terminal board.

At least one of the two terminal boards may have a plurality of through holes.

When an insulator is provided between the two terminal boards, the insulator may have a through hole or a recess in a region between the two terminal boards.

The through hole may have a circular shape, a polygonal shape, or a slit shape arranged in parallel along a width of the terminal board.

The through hole is preferably provided in each of opposite positions of the two terminal boards.

Further the through hole or the recess provided in the insulator is preferably formed substantially coaxially with the through hole provided in each of the opposite positions of the two terminal boards.

BRIEF DESCRIPTION OF THE DRAWINGS

FIG. 1 is a schematic view of an antenna coil device according to Embodiment 1 of the present invention.

DESCRIPTION OF THE PREFERRED EMBODIMENTS

Figure 8:
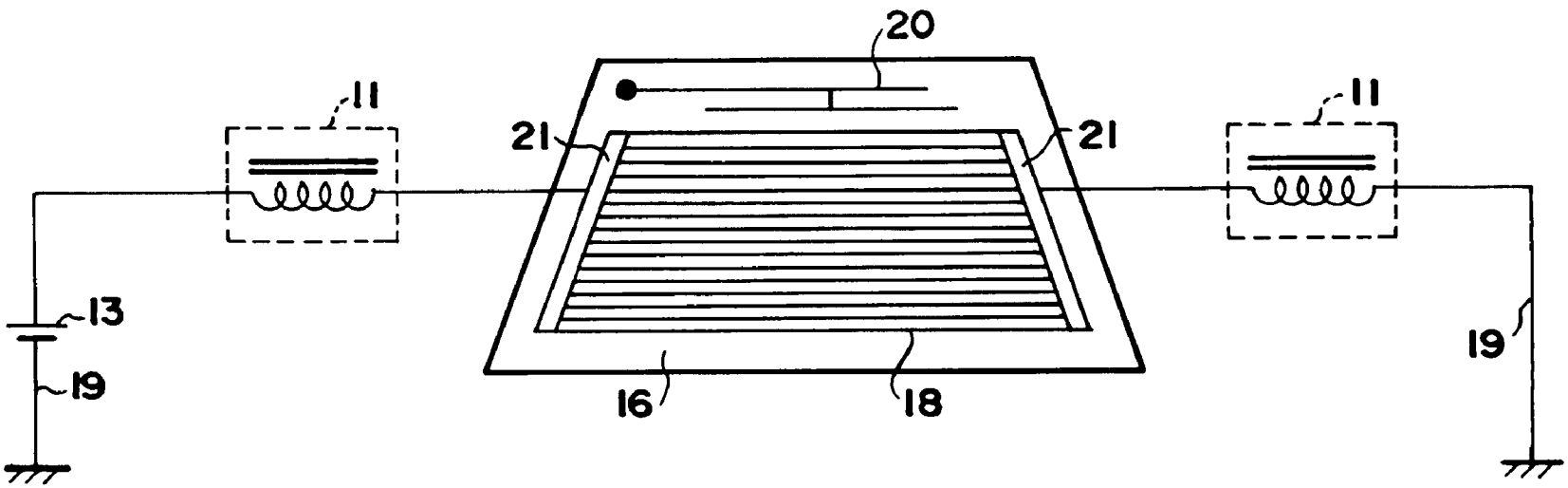
FIG. 8 is a conceptual view of a connecting state of a general antenna coil device.

Now, an antenna coil device according to an embodiment of the present invention will be described in detail with reference to the accompanying drawings. The antenna coil device according to the embodiment removes noise (for example, output noise from a battery) in radio waves of radio broadcast or TV broadcast received by a glass antenna of an automobile, improves sensitivity of the antenna, and is connected between a battery 13 and heating elements 18 provided in a rear window 16 of the automobile, for example onto a busbar 21, as shown in FIG. 8. In the example shown in FIG. 8, wiring 20 in an upper portion of a part where the heating elements 18 is provided constitutes a radio antenna, and the heating elements 18 constitutes a TV antenna.

Figure 1A:
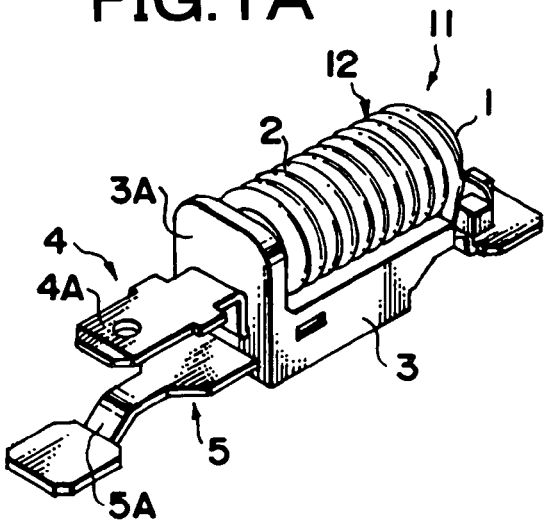
FIG. 1A is a top perspective view.
Figure 1B:
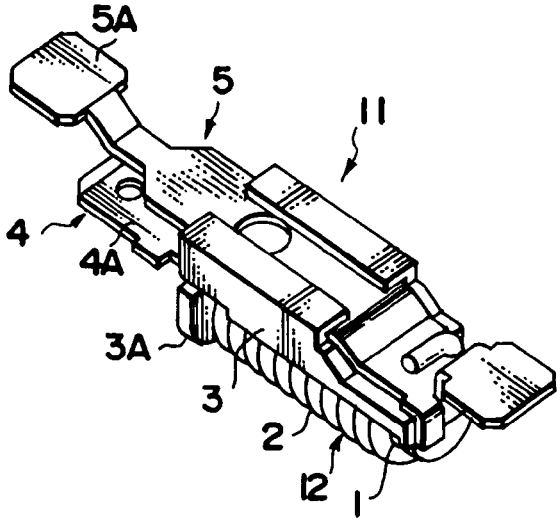
FIG. 1B is a bottom perspective view.
Figure 1C:
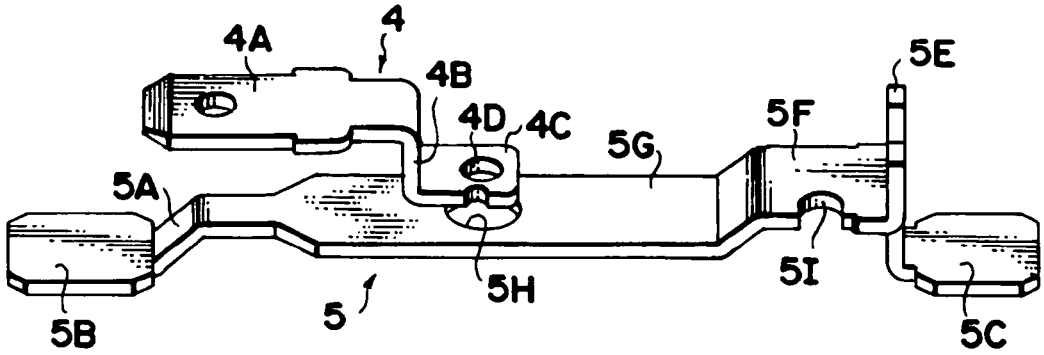
FIG. 1C is a perspective view of terminal boards only.

FIG. 1 shows an antenna coil device 11 according to Embodiment 1 of the present invention, and FIG. 1A is a top perspective view, FIG. 1B is a bottom perspective view, and FIG. 1C is a perspective view of terminal boards only.

As shown in FIGS. 1A and 1B, in the antenna coil device 11 according to Embodiment 1, a coil portion 12 having a lead wire 2 wound around a magnetic core 1 is mounted on a case 3 made of plastic resin, and on one side (hereinafter referred to as a front side) of the case 3, terminal board 4 and terminal board 5 that electrically connect one end and the other end of the lead wire 2 of the coil portion 12 to an external device are placed in a protruding manner. The two terminal boards 4 and 5 can be externally connected at protruding end portions 4A and 5A provided so as to protrude from the front side of the case 3, and are thus vertically spaced at a predetermined distance.

FIG. 1C schematically shows a placement state of the terminal boards 4 and 5 only. The terminal boards 4 and 5 are formed of metal plates of brass or the like, and actually, a portion of the case 3 is placed between the terminal boards 4 and 5.

As shown, the terminal board 4 is generally formed into a crank shape, and has a rising portion 4B continued to the protruding end portion 4A and placed along a front board 3A of the case 3, and an inserting end portion 4C inserted into the case 3. One end of the lead wire 2 of the coil portion 12 is electrically connected to the inserting end portion 4C seated below the coil portion 12.

On the other hand, the terminal board 5 is long axially of the coil portion 12, and has, at both ends thereof, mounting surfaces 5B and 5C to be joined onto a busbar 21 (see FIG. 8) by soldering.

Each end of the terminal board 5 including the mounting surfaces 5B and 5C has a substantial crank shape, and has a rising portion 5E continued to the rear mounting surface 5C and placed along a rear end of the case 3, and a connecting portion 5F of the lead wire 2 placed in the case 3. The other end of the lead wire 2 of the coil portion 12 is inserted into a notch 5I and bent at the connecting portion 5F, and is electrically connected to the terminal board S.

The terminal board 5 also has a central flat portion 5G that connects the both ends having the substantial crank shape.

As shown in FIG. 1C, the inserting end portion 4C of the terminal board 4 is seated below the coil portion 12, while the central flat portion 5G of the terminal board 5 is placed above the mounting surfaces 5B and 5C so as to be spaced from a surface of the busbar, and thus the inserting end portion 4C of the terminal board 4 and the central flat portion 5G of the terminal board 5 are placed close to and opposite each other.

In this way, in the antenna coil device 11, the two terminal boards 4 and 5 are placed close to and opposite each other at part thereof, thus causing stray capacitance between the terminal boards 4 and 5.

Further, the antenna coil device 11 is mounted to an automobile, and thus each of the terminal boards 4 and 5 is as wide as the coil portion 12 and has a large area in order to increase strength. This increases an area of an opposite region between the terminal boards 4 and 5, thus inevitably increasing stray capacitance proportional to the area of the opposite region.

A self resonance frequency f is expressed by the following formula (1), $$f=1/(2\pi(LC)^{1/2}) \quad (1)$$

where C is a stray capacitance component and L is an inductance component of the coil (inductor). Thus, the self resonance frequency f decreases as the stray capacitance component C increases.

The stray capacitance component C is approximated by the following formula (2), $$C=\in(S/d) \quad (2)$$

where S is the area of the opposite region between the terminal boards 4 and 5, d is a distance between the terminal boards 4 and 5, and $\in$ is a dielectric constant of the case to which the coil is secured together with the terminal boards 4 and 5. Thus, the stray capacitance component C increases as the area S increases or the dielectric constant ∈ of the material of the case increases, which reduces the self resonance frequency f.

This causes the following problem in conventional devices.

Specifically, FM broadcast in Japan uses a frequency band of 76 to 90 MHz, and broadcast in Europe and the United States uses a frequency band of 87 to 108 MHz, and generally, it is important that a self resonance frequency band, where an impedance of an antenna coil device is 2 KΩ or more, covers a range of around 76 to 108 MHz in order to remove noise or improve sensitivity of an antenna.

Figure 2:
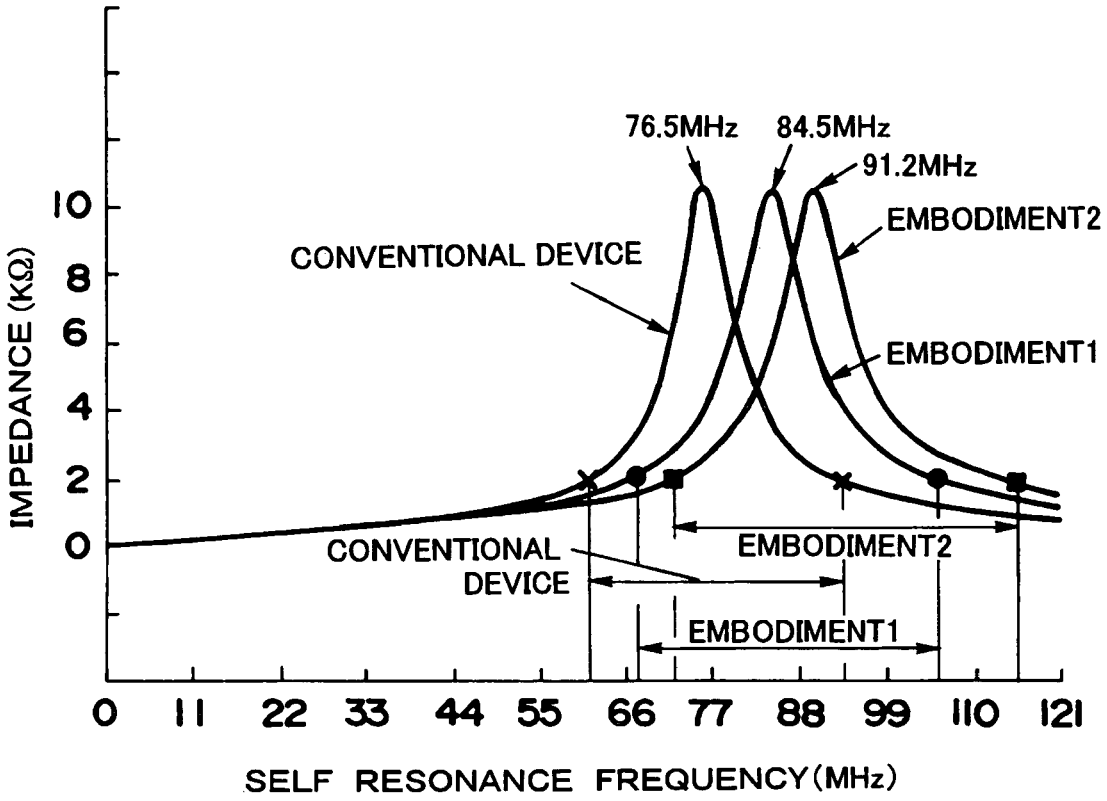
FIG. 2 shows self resonance frequency—impedance characteristics of the antenna coil device shown in FIGS. 1 and 5 and a conventional antenna coil device.

However, in the conventional devices in which terminal boards 4 and 5 per se are not adapted to reduce stray capacitance, the above described increase in the stray capacitance causes a self resonance frequency band where an impedance is 2 KΩ or more to decrease to a range of around 61 to 93 MHz (a bandwidth of 32 MHz) as shown in FIG. 2, and the impedance of 2 KΩ or more cannot be ensured in a self resonance frequency band of around 93 MHz or more. Thus, the conventional devices inappropriately function as noise removing elements, and also reduce sensitivity of an antenna.

For this reason, in the coil device 11 according to Embodiment 1, as shown in FIG. 1C, a through hole 4D is provided in the inserting end portion 4C of the terminal board 4, a through hole 5H is provided in the central flat portion 5G of the terminal board 5, and the two through holes 4D and 5H are placed opposite each other.

As described above, the stray capacitance component C caused between the two terminal boards 4 and 5 is significantly determined according to the area S of the opposite region between the inserting end portion 4C of the terminal board 4 and the central flat portion 5G of the terminal board 5. Thus, providing the through holes 4D and 5H in the inserting end portion 4C and the central flat portion 5G to reduce the area S of the opposite region can easily reduce the stray capacitance component C caused between the two terminal boards 4 and 5.

Thus, in the coil device 11 according to Embodiment 1, a self resonance frequency band where an impedance is 2 KΩ or more can be shifted to a high frequency side as compared with the conventional devices, and the impedance of 2 KΩ or more can be ensured even in a predetermined self resonance frequency band of around 93 MHz or more.

The inductance of the coil is preferably 1.5 to 10 μH.

An amount of shift to the high frequency side as described above is determined according to each area of the two through holes 4D and 5H or an area of an overlapping region therebetween, as well as an area of the inserting end portion 4C, an area of the central flat portion 5G, and a distance between the inserting end portion 4C and the central flat portion 5G. For example, the amount of shift of the self resonance frequency to the high frequency side is about 5% to 10%, when the area of the through hole 4D is $\pi$ mm$^2$ (a circle with a 2 mm diameter), the area of the through hole 5H is $4\pi$ mm$^2$ (a circle with a 4 mm diameter), the area of the overlapping region between the two through holes 4D and 5H is $\pi$ mm$^2$ (with a 2 mm diameter), the area of the inserting end portion 4C is about $(25-\pi)$ mm$^2$ (with an about 5 mm width), the area of the central flat portion 5G is about 180 mm$^2$ (with an about 7 mm width), and the distance between the inserting end portion 4C and the central flat portion 5G is about 1.6 mm.

Specifically, as shown in FIG. 2, a peak of the self resonance frequency in Embodiment 1 is 84.5 MHz, while a peak of the self resonance frequency in the conventional device is 76.5 MHz, and thus the amount of shift of the self resonance frequency to the high frequency side is about 10%.

In Embodiment 1, the self resonance frequency band where the impedance is 2 KΩ or more is 68 to 106 MHz (a bandwidth of 38 MHz), and is wider than those in the conventional devices described in Japanese Unexamined Patent Publication Nos. HEI 8-335820 and HEI 9-213528 to cover all the range of the FM frequency band. Thus, the coil device according to Embodiment 1 sufficiently functions as a noise removing element, and improves sensitivity of the antenna.

As described above, the self resonance frequency band where the impedance is 2 KΩ or more in the conventional devices is around 61 to 93 MHz as shown in FIG. 2, and thus in Embodiment 1, the amount of shift of the self resonance frequency on both a lower limit side and an upper limit side is about 10%.

In the coil device 11 according to Embodiment 1, providing the through holes 4D and 5H also prevents a reduction in strength of the terminal boards 4 and 5.

Specifically, the through hole 4D is formed around a point on a center line along a width of the inserting end portion 4C, and the through hole 5H is formed around a point on a center line along a width of the central flat portion 5G.

Further, the size of the through hole 4D is ¾ or less of the width of the inserting end portion 4C, and the size of the through hole 5H is ¾ or less of the width of the central flat portion 5G. This is important for ensuring the strength and preventing heating by the terminal boards 4 and 5 of the coil device.

The numbers and the positions of the through hole 4D provided in the inserting end portion 4C and the through hole 5H provided in the central flat portion 5G are not limited to those shown in FIG. 1C, but various changes may be made.

Figure 3:
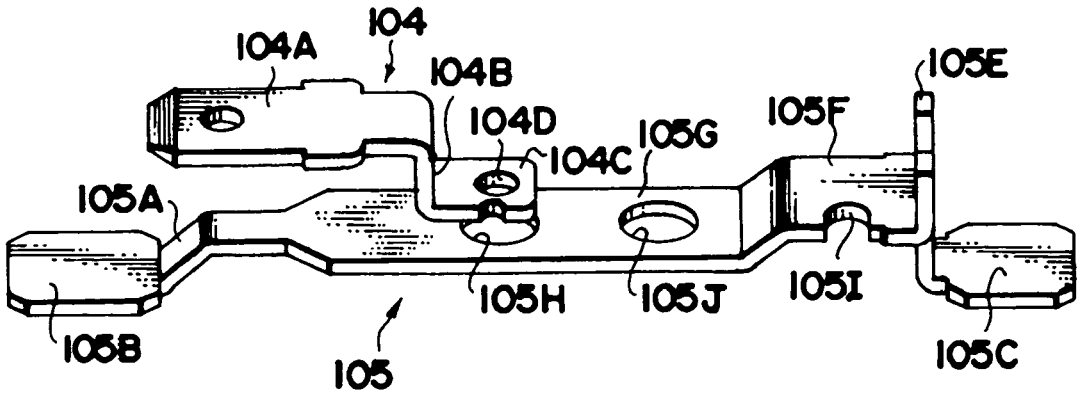
FIG. 3 is a schematic perspective view of terminal boards only of an antenna coil device according to a modification of Embodiment 1.
Figure 4:
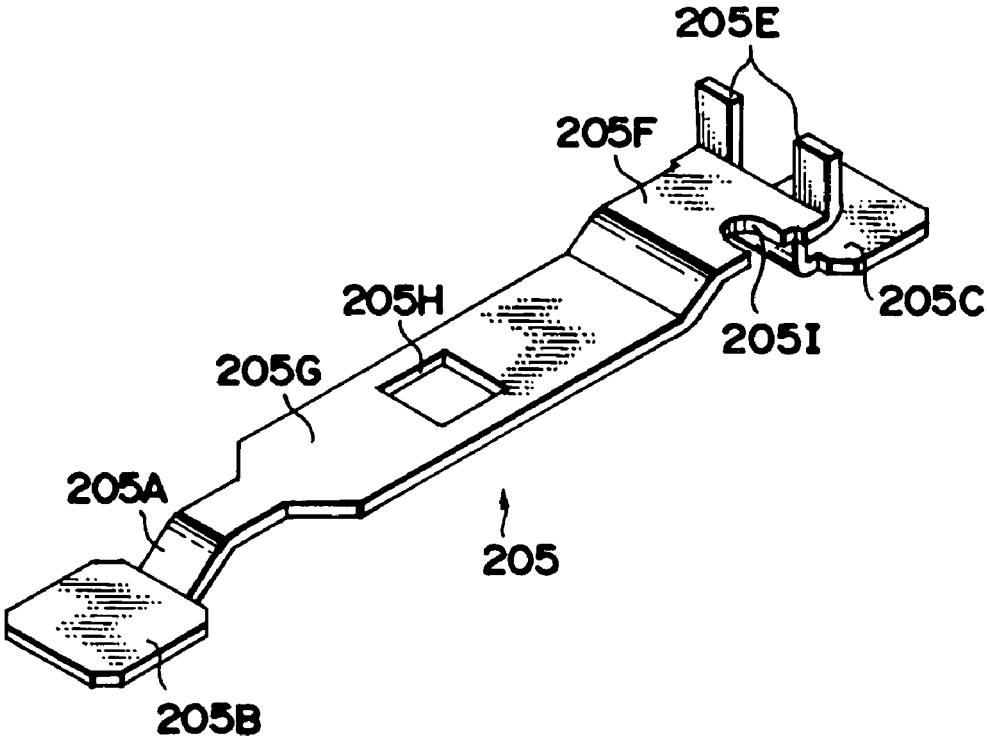
FIG. 4 is a schematic perspective view of one of the terminal boards only of the antenna coil device according to the modification of Embodiment 1.

FIGS. 3 and 4 shows modifications of Embodiment 1. The same members as the members in FIG. 1C are denoted by reference numerals of the members with 100 (in FIG. 3) or 200 (in FIG. 4) added, and detailed descriptions thereof will be omitted.

Specifically, in the modified embodiment shown in FIG. 3, a plurality of through holes 105H and 105J are provided in a terminal board 105. The through hole 105H is provided opposite a through hole 104D provided in an inserting end portion 104C of a terminal board 104, while the through hole 105J is not provided opposite the through hole 104D of the inserting end portion 104C but separately provided. In order to reduce stray capacitance, it is effective that the through holes in the two terminal boards 104 and 105 are placed opposite each other, but the through hole 105J can reduce the stray capacitance to a certain degree even in a state where the through hole 105J is provided in one of the terminal boards 104 and 105, and the other of the terminal boards 104 and 105 has no through hole opposite the through hole 105J. The through hole 105J also reduces a weight of the terminal board 105.

A modified embodiment shown in FIG. 4 indicates that a through hole in a terminal board may have any shape. Specifically, as shown in FIG. 4, a through hole 205H provided in a terminal board 205 has a rectangular shape. Of course, various shapes other than the rectangular shape may be used, and the through hole may have a triangular, pentagonal or other polygonal shape, or a slit shape extending along a length of the terminal board 205 and arranged in parallel along a width thereof. This applies to a through hole in a terminal board (not shown) opposite the terminal board 205.

In the antenna coil device according to Embodiment 1 (including the modifications), the two terminal boards 4, 104, 5, 105, and 205 are placed opposite each other, and each have the through holes 4D, 104D, 5H, 105H, 105J and 205H, thereby reducing the stray capacitance caused between the two terminal boards 4, 104, 5, 105 and 205. In addition to this, a through hole or a recess may be provided in an insulator placed between the two terminal boards 4, 104, 5, 105 and 205 to further reduce the stray capacitance caused between the two terminal boards 4, 104, 5, 105 and 205.

Specifically, as described in Embodiment 1, the two terminal boards 4 and 5 are placed opposite each other in the case 3 with a portion of the case 3 placed therebetween. As described above, the case 3 is formed of an insulator of plastic resin, and has a higher dielectric constant than air. This may increase the stray capacitance caused between the terminal boards 4 and 5.

Figure 5A:
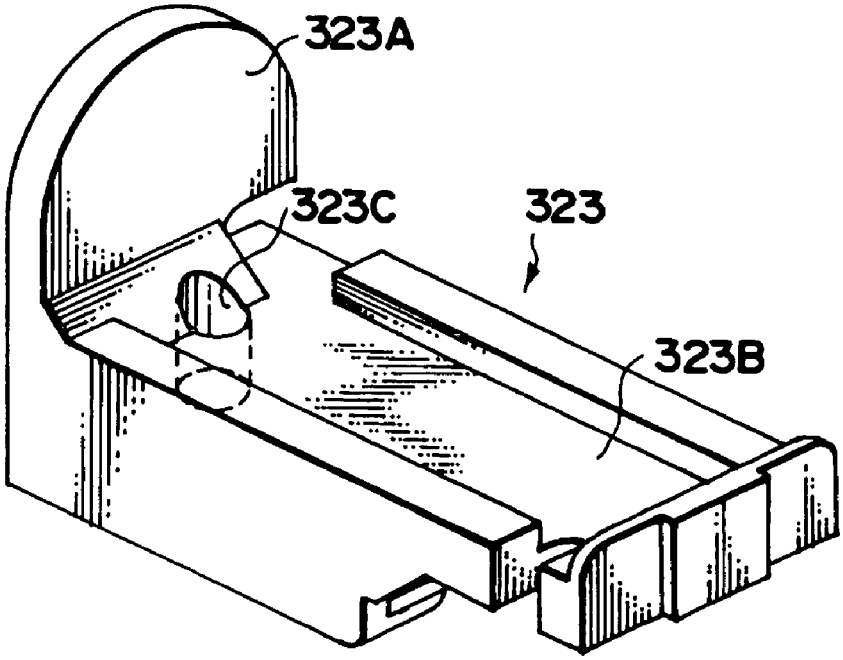
FIG. 5A is a perspective view of a case portion of an antenna coil device according to Embodiment 2 of the present invention, and FIG. 5B diagrammatically shows an operation of the case portion.

Thus, in an antenna coil device according to Embodiment 2, as shown in FIG. 5A, a through hole 323C (with a 3 mm diameter) is provided in a portion of a case 323 placed between two terminal boards 4 and 5 (a positional relationship to the case is similar to the positional relationship to the case 3 shown in FIG. 1A; denoted in FIG. 5A by the same reference numerals 4 and 5 as in FIG. 1A), and an air space is provided between the two terminal boards 4 and 5 to reduce a dielectric constant, thereby reducing stray capacitance caused between the terminal boards 4 and 5. The case 323 has the same shape as the case 3 shown in FIG. 1, and the through hole 323C is provided in a position close to a front board 323A in a coil mounting portion 323B.

Figure 5B:
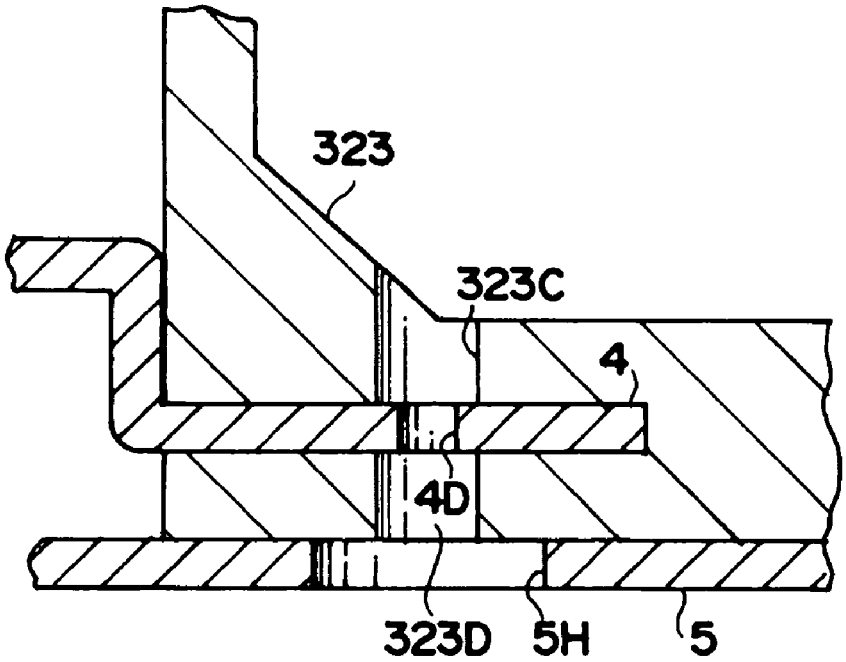

Specifically, as is apparent from FIG. 5B diagrammatically showing the positional relationship between the two terminal boards 4 and 5 and the through hole 323C of the case 323, the reduction in the stray capacity is achieved by the reduction in the dielectric constant caused by a portion of the case 323 provided between the two terminal boards 4 and 5 being replaced with the air space formed by the through hole 323C.

Providing the through hole 323C in the case 323 between the two terminal boards 4 and 5 can reduce the stray capacitance component C, and thus a peak of a self resonance frequency can be shifted to a higher frequency side as compared with Embodiment 1. Specifically, as shown in FIG. 2, the peak of the self resonance frequency in Embodiment 2 is 91.2 MHz, and can be further shifted about 8% to the high frequency side as compared with Embodiment 1 (the peak of the self resonance frequency is 84.5 MHz).

Figure 6A:
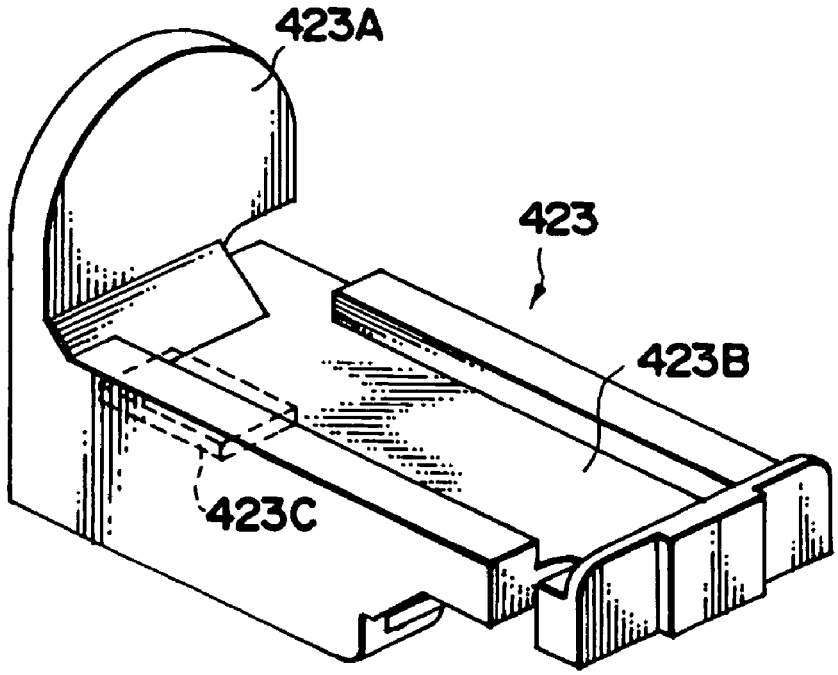
FIG. 6A is a perspective view of a case portion of an antenna coil device according to a modification of Embodiment 2, and FIG. 6B diagrammatically shows an operation of the case portion.

Instead of the through hole 323C shown in FIG. 5A, a recess 423C having a rectangular section may be provided in a bottom surface of a case 423 as shown in FIG. 6A.

Figure 6B:
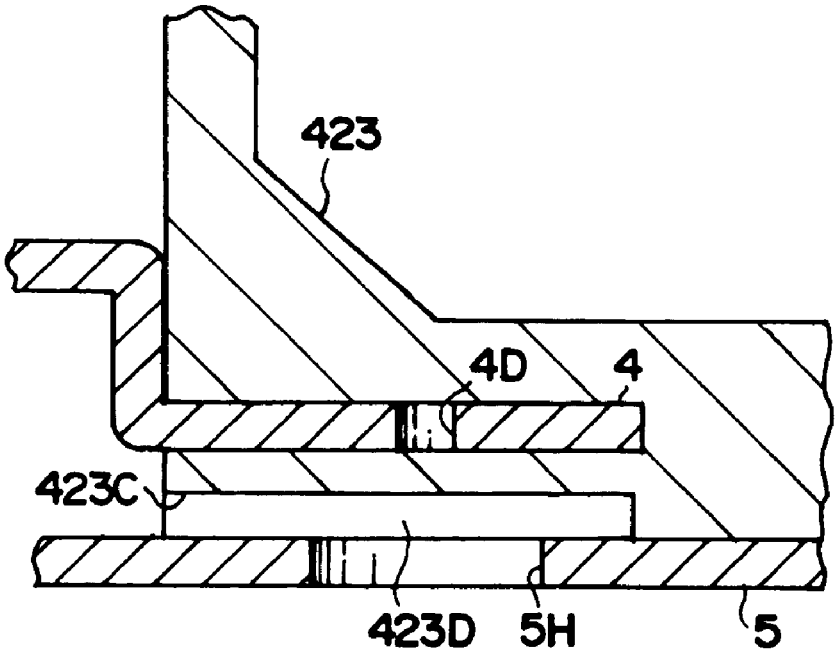

Specifically, as is apparent from FIG. 6B diagrammatically showing a positional relationship between the two terminal boards 4 and 5 and the recess 423C of the case 423, the reduction in the stray capacity is achieved by the reduction in the dielectric constant caused by a portion of the case 423 provided between the two terminal boards 4 and 5 being replaced with an air space formed by the recess 423C.

Figure 7A:
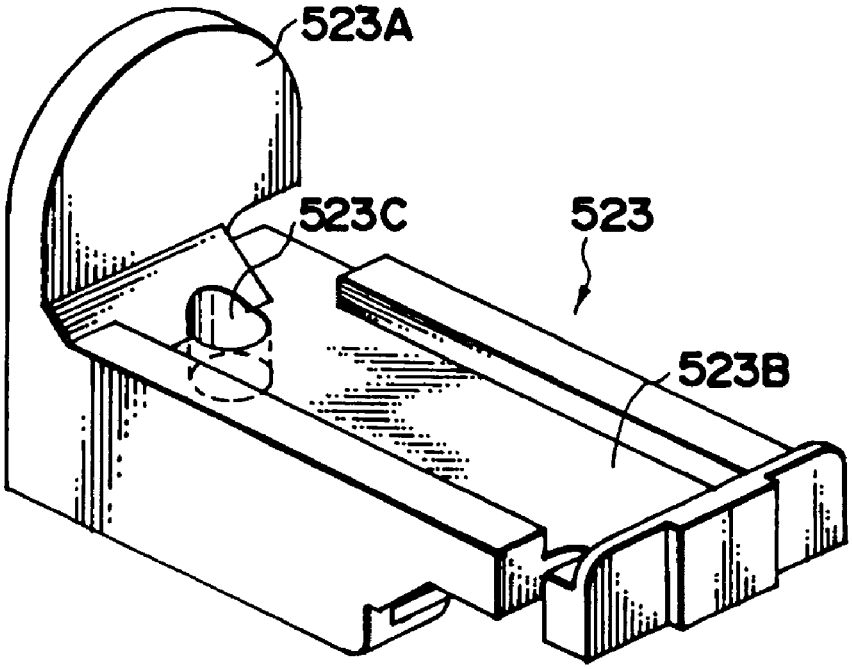
FIG. 7A is a perspective view of a case portion of an antenna coil device according to a modification of Embodiment 2, and FIG. 7B diagrammatically shows an operation of the case portion.

Instead of the through hole 323C shown in FIG. 5A, a recess 523C having a circular section may be provided in a top surface of a case 523 so as to extend to below the terminal board 4 as shown in FIG. 7A.

Figure 7B:
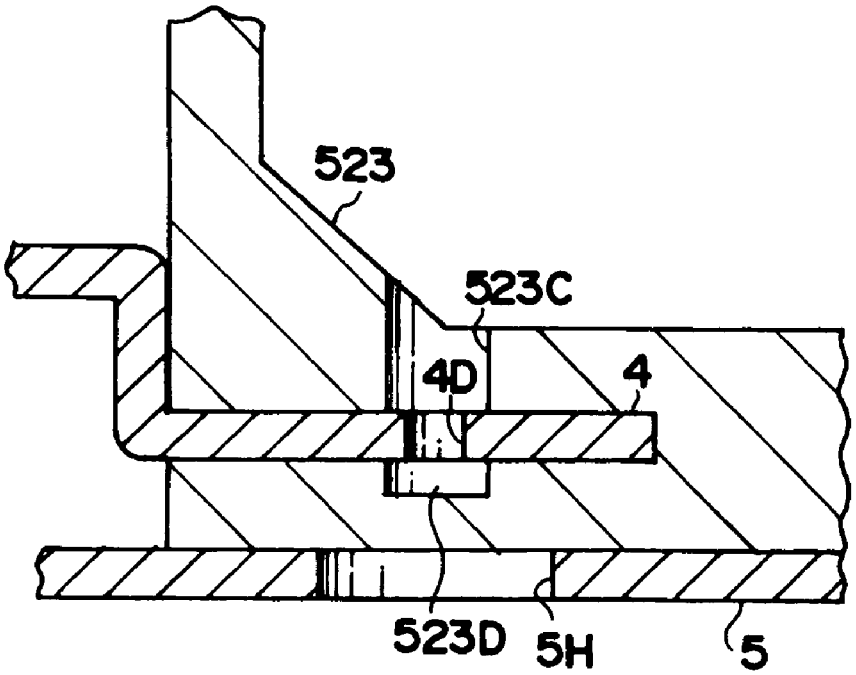

Specifically, as is apparent from FIG. 7B diagrammatically showing a positional relationship between the two terminal boards 4 and 5 and the recess 523C of the case 523, the reduction in the stray capacity is achieved by the reduction in the dielectric constant caused by a portion of the case 523 provided between the two terminal boards 4 and 5 being replaced with an air space formed by the recess 523C.

In the antenna coil device shown in FIGS. 5 to 7, the through hole 323C, the recess 423C, and the recess 523C are each placed on a line connecting the through holes 4D and 5H of the two terminal boards 4 and 5, but the through hole and the recesses for reducing the dielectric constant of the region between the two terminal boards 4 and 5 do not always have to be placed on the line connecting the through holes 4D and 5H of the two terminal boards 4 and 5, and may be provided in any case portions between the two terminal boards 4 and 5.

The shapes of the through hole 323C, the recess 423C, and the recess 523C are not limited to those described above, but various shapes may be selected.

The antenna coil device according to the present invention is not limited to the embodiments and the modifications thereof. For example, the antenna coil device may be mounted to not only an automobile but also to various mobile units that cannot avoid vibration while moving such as a train, an airplane, a helicopter and so on, and it is useful in removing noise in radio wave signals received by various types of antennas and improving receiving sensitivity.

Further, the antenna coil device can be applied to receiving not only radio waves of FM radio broadcast and TV broadcast, but also all the range of a VHF band. When the antenna coil device for FM radio broadcast is adapted to receive other VHF band broadcast, the same operational advantage can be obtained simply by changing an L value of the coil.

As described above, according to the antenna coil device of the invention, the two terminal boards to which the coil winding is connected are placed opposite each other, and each terminal board has the through hole. This reduces an area of an opposite region between the two terminal boards, and reduces stray capacitance caused between the two terminal boards.

In addition, the insulator placed between the two terminal boards has the through hole or the recess to reduce a dielectric constant of the region between the two terminal boards, thereby reducing stray capacitance caused between the terminal boards.

Thus, a self resonance frequency band where an impedance is equal to or above a predetermined value, specifically, a band that has a noise removing function and improves sensitivity of the antenna can be shifted to a high frequency side as compared with the conventional devices, and a wider bandwidth can be obtained as compared with the conventional devices, thereby satisfactorily removing noise in a desired radio wave signal frequency band, and improving sensitivity of the antenna.

What is claimed is:

1. An antenna coil device wherein said coil device is connected to a busbar of defogging heating elements of a window glass of a mobile unit, wherein said coil device holds a coil by a holding member formed of an insulator and two terminal boards to which a winding of said coil is connected, wherein the two terminal boards to which the winding of the coil is connected are placed opposite each other, and at least one of said two terminal boards has a through hole in a region where said two terminal boards are opposite to each other, and wherein when an insulator is provided between said two terminal boards, said insulator has a through hole or a recess in a region between said two terminal boards.

2. An antenna coil device wherein said coil device is connected to a busbar of defogging heating elements of a window glass of a mobile unit, wherein said coil device holds a coil by a holding member formed of an insulator and two terminal boards to which a winding of said coil is connected, wherein the two terminal boards to which the winding of the coil is connected are placed opposite each other, and at least one of said two terminal boards has a through hole in a region where said two terminal boards are opposite to each other, wherein said through hole is provided in each of opposite positions of said two terminal boards, and wherein when an insulator is provided between said two terminal boards, said insulator has a through hole or a recess in a region between said two terminal boards.

3. The antenna coil device according to claim 2, wherein said through hole has a circular shape, a polygonal shape, or a slit shape arranged in parallel along a width of said terminal board.

4. The antenna coil device according to claim 2, wherein said through hole or said recess provided in said insulator is formed substantially coaxially with the through hole provided in each of the opposite positions of said two terminal boards.

* * * * *